US006560792B2

(12) United States Patent
Rosenquist

(10) Patent No.: US 6,560,792 B2
(45) Date of Patent: May 13, 2003

(54) SUPPORT STRUCTURE FOR A BED OR THE LIKE

(76) Inventor: Terry L. Rosenquist, 835 N. Hewett St., Hastings, NE (US) 68901

( * ) Notice: Subject to any disclaimer, the term of this patent is extended or adjusted under 35 U.S.C. 154(b) by 0 days.

(21) Appl. No.: 09/977,817

(22) Filed: Oct. 15, 2001

(65) Prior Publication Data

US 2003/0041376 A1 Mar. 6, 2003

Related U.S. Application Data

(63) Continuation-in-part of application No. 09/946,042, filed on Sep. 4, 2001.

(51) Int. Cl.[7] ..... A47D 7/00
(52) U.S. Cl. ..... 5/9.1; 5/1; 5/8; 5/11
(58) Field of Search ..... 5/9.1, 1, 2.1, 8, 5/11; 403/119, 330, 354, 154, 150

(56) References Cited

U.S. PATENT DOCUMENTS

| | | | | | |
|---|---|---|---|---|---|
| 631,962 | A | | 8/1899 | Lein | |
| 665,535 | A | | 1/1901 | Lein | |
| 669,175 | A | | 3/1901 | Lein | |
| 822,592 | A | | 6/1906 | Dowling | |
| 860,941 | A | | 7/1907 | Rodrigues | |
| 895,898 | A | * | 8/1908 | Scheer | 5/9.1 |
| 932,479 | A | * | 8/1909 | Linxweiler | 5/210 |
| 958,895 | A | | 5/1910 | Rodrigues | |
| 1,001,946 | A | | 8/1911 | Gumm | |
| 1,089,545 | A | | 3/1914 | Gosso | |
| 1,195,637 | A | | 8/1916 | Anderson | |
| 1,235,336 | A | * | 7/1917 | Lathrop | 5/9.1 |
| 1,253,549 | A | | 1/1918 | Weaver | |
| 1,275,774 | A | * | 8/1918 | Silvester | 5/9.1 |
| 1,325,320 | A | | 12/1919 | Gosso | |
| 1,336,480 | A | * | 4/1920 | Nelson | 217/64 |
| 1,349,962 | A | | 8/1920 | Janson et al. | |
| 1,944,909 | A | * | 1/1934 | Thomas | 5/9.1 |
| 2,478,088 | A | * | 8/1949 | Causey | 242/599.3 |
| 3,215,387 | A | | 11/1965 | Thompson et al. | |
| 3,572,783 | A | * | 3/1971 | Sosalla | 403/3 |
| 3,858,254 | A | | 1/1975 | Coomes | |
| 4,084,276 | A | | 4/1978 | Trexler, Jr. et al. | |
| 4,481,748 | A | * | 11/1984 | D'Alessio et al. | 52/638 |
| 5,233,707 | A | * | 8/1993 | Perkins | 182/178.5 |
| 5,655,234 | A | * | 8/1997 | Randleas | 5/11 |
| 5,701,616 | A | | 12/1997 | Rosenquist | |
| 6,018,829 | A | | 2/2000 | Rosenquist | |
| 6,161,320 | A | * | 12/2000 | Peterson | 40/605 |
| 6,167,579 | B1 | * | 1/2001 | Kopish | 108/107 |
| 6,292,959 | B1 | * | 9/2001 | Rosenquist | 403/362 |

FOREIGN PATENT DOCUMENTS

FR 002603478 A1 * 3/1988 ..... A61G/1/06

OTHER PUBLICATIONS

Photo, 1 page, from http.www.mtc.com.my/industry/mfic/tag/beds_series/Carina_loft_bed.jpg, undated.*

* cited by examiner

*Primary Examiner*—Heather Shackelford
*Assistant Examiner*—Katherine Mitchell
(74) *Attorney, Agent, or Firm*—Thomte, Mazour & Niebergall; Dennis L. Thomte

(57) ABSTRACT

A support is provided for a bed or the like which provides one hundred percent unobstructed floor space therebelow. The support may be used for supporting a pair of vertically spaced beds or a bed having a desk or sofa positioned therebelow. The support comprises upstanding first and second end frames which are horizontally spaced-apart and which have guardrails secured to the upper ends thereof. Cross supports extend between the guardrails for supporting a bed thereon. Accessory supports optionally extend between the first and second end frames for supporting a desk or sofa thereon. The support may be quickly assembled and disassembled without the use of tools.

12 Claims, 5 Drawing Sheets

SUPPORT STRUCTURE FOR A BED OR THE LIKE

CROSS-REFERENCE TO RELATED APPLICATION

This is a continuation-in-part application of Petitioner's earlier application Ser. No. 09/946,042 filed Sep. 4, 2001, entitled SUPPORT STRUCTURE FOR A BED OR THE LIKE.

BACKGROUND OF THE INVENTION

1. Technical Field

The present invention is directed to a load-bearing support structure for a bed or the like which provides substantially one hundred percent unobstructed floor space in sleeping quarters such as dormitories or the like. The present invention discloses a unique support structure which may be easily assembled without the need for tools. The support system is conveniently disassembled for movement to a different location and/or storage.

2. Description of the Prior Art

Many educational institutions provide dormitories in order to accommodate students who are required to live on campus. Dormitories are generally multistory buildings having a central elevator and stairway corridor. On either side of the central area is a hallway having a plurality of small rooms located on either side of the hallway. These small rooms generally do not have bathrooms.

Each room has a small closet and is usually furnished with two single beds, two desks, two lamps, two chairs, and a dresser or bureau. Even though each room contains a minimal amount of furniture, the rooms are small and space is at a premium.

Since these rooms are small and sparse, it is difficult for two people to live comfortably within the room. This is true since most dorm rooms lack sufficient space to maintain a stereo, television, small refrigerator, or to store a bicycle and the like.

Students desiring a more livable environment often remove their beds or make the existing two single beds into a lower and upper berth bunk bed. With the same goal in mind, students also replace their beds with futon mattresses.

Load-bearing scaffolds are well-known in the construction arts. Such scaffolds are generally adapted for supporting workmen, construction equipment, and building materials. Also known are bunks and berths adapted to provide sleeping accommodations for passengers, military personnel, students, or small children. These apparatus are often adapted to be supported from poles anchored to the floor and ceiling of a room. For example, apparatus of this general species are disclosed by Lein U.S. Pat. No. 665,535; Rodrigues U.S. Pat. No. 958,895; Gosso U.S. Pat. No. 1,325,320; and Gosso U.S. Pat. No. 1,089,545.

Also known to the art are bunks or berths adapted to be supported by anchoring the bunk or berth to a wall. For example, apparatus of this general species are disclosed by Lein U.S. Pat. No. 669,175; Dowling U.S. Pat. No. 822,592; Rodrigues U.S. Pat. No. 860,941; Gumm U.S. Pat. No. 1,001,946; Thompson, et al. U.S. Pat. No. 3,215,387; Coomes U.S. Pat. No. 3,858,254; and Trexler, Jr., et al. U.S. Pat. No. 4,084,276.

Inventions of this type are unsuitable for the present objects since their installation requires that they become room fixtures. Additionally, such bunks or berths necessarily require the dedication of otherwise useful floor space.

Freestanding bunk beds are also known to the bunk and berth art. Examples of this type of bed may be found disclosed by Lein U.S. Pat. No. 631,962; Anderson U.S. Pat. No. 1,195,637; Weaver U.S. Pat. No. 1,253,549; and Janson, et al. U.S. Pat. No. 1,349,962.

U.S. Pat. No. 5,701,616 provided a support structure for beds and the like which derived at least some of its support from the interior surfaces of a room. Although the device of U.S. Pat. No. 5,701,616 represented an advance in the art, the invention described in U.S. Pat. No. 6,018,829 was an advance thereover due to the fewer components parts, ease of assembly, and superior strength.

It is believed that the invention described in the co-pending application represented an advance over the prior art described above and applicant's earlier inventions due to the unique method of assembling and disassembling the structure which does not require the use of tools. It is believed that the instant invention represents an advance over applicant's co-pending application due to the method of attaching the cross braces to the structure.

SUMMARY OF THE INVENTION

The present invention provides a support structure for a bed or the like while providing one hundred percent unobstructed floor space therebelow. The support structure may also be used for supporting a bed having a desk or sofa positioned therebelow. The support structure is comprised of upstanding first and second lower end frames which are horizontally spaced from one another; upstanding first and second upper end frames removably mounted on the upper ends of the first and second lower end frames, respectively; first and second guardrails mounted on the upper ends of the first and second upper end frames; mattress supports which are secured to and which extend between the first and second guardrails for supporting a mattress thereon; accessory supports which are secured to and which extend between the first and second lower end frames or which extend between the first and second upper end frames for supporting accessories thereon such as a desk, sofa, etc.; a first cross brace which is removably secured to the first upper end frame and which is removably secured to the second lower end frame; and a second cross brace which is secured to the first lower end frame and removably secured to the second upper end frame. The support structure may be assembled without the use of tools and may be quickly disassembled without the use of tools.

It is therefore a principal object of the invention to provide an improved support structure for a bed or the like.

A further object of the invention is to provide a structure for supporting a bed or the like which may be assembled and disassembled without the use of tools.

Yet another object of the invention is to provide a support structure for a bed or the like but which also may be used to support an additional bed, sofa, or desk thereon.

These and other objects will be obvious to those skilled in the art.

DESCRIPTION OF THE PREFERRED EMBODIMENT

Figure 1:
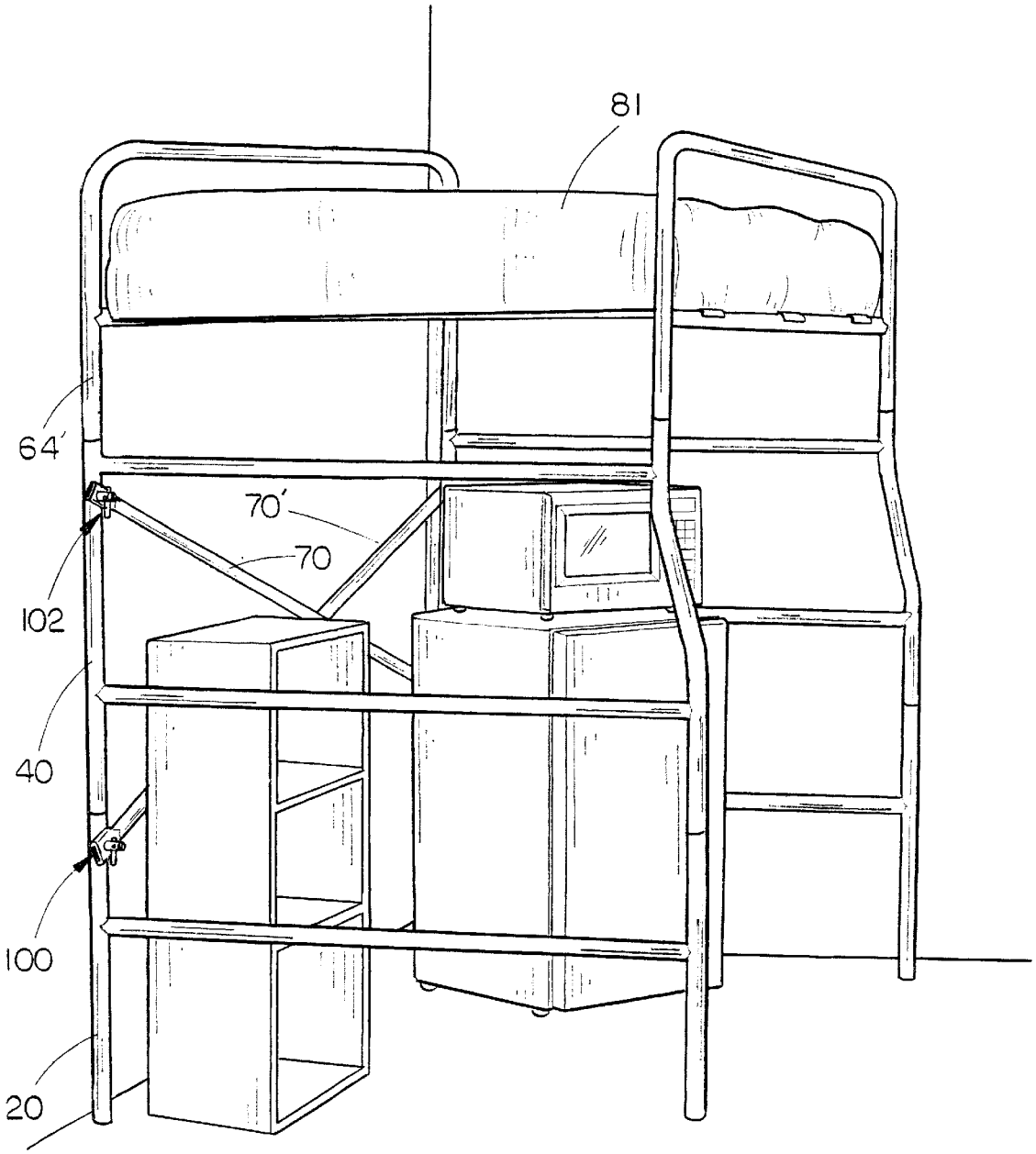
FIG. 1 is a perspective view of the support structure of this invention in an assembled condition with a mattress positioned thereon.
Figure 2:
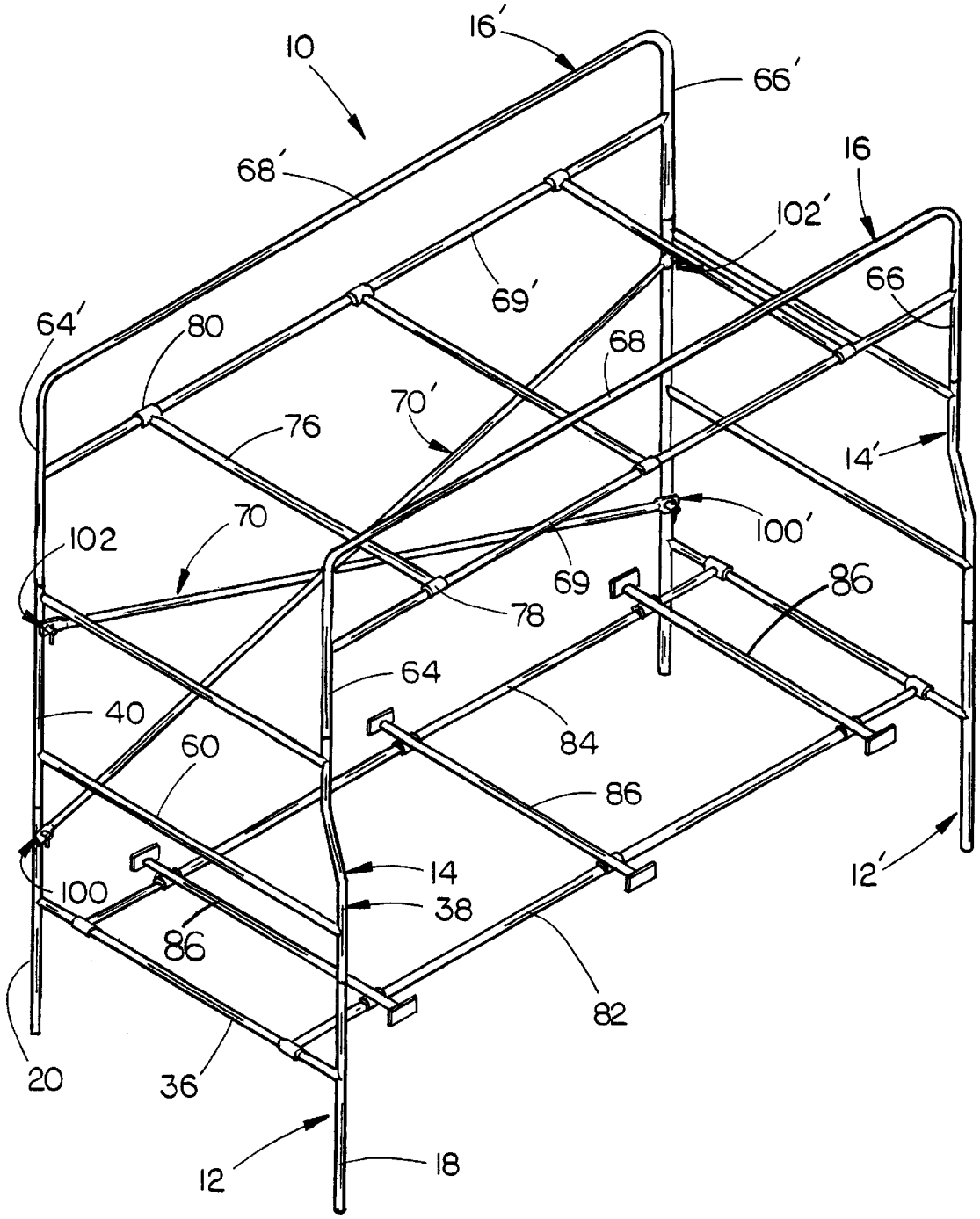
FIG. 2 is a perspective view of the support structure in an assembled condition with accessory supports positioned on the lower end frames.

The support structure of this invention is referred to generally by the reference numeral 10. Generally speaking, support structure 10 includes lower end frames 12 and 12', upper end frames 14 and 14', and guardrails 16 and 16'. Inasmuch as lower end frame 12' is identical to lower end frame 12, only lower end frame 12 will be described in detail with "'" indicating identical structure on lower end frame 12'. Further, inasmuch as upper end frame 14' is identical to upper end frame 14, only upper end frame 14 will be described in detail with "'" indicating identical structure on upper end frame 14'. Additionally, inasmuch guardrail 16' is identical to guardrail 16, only guardrail 16 will be described in detail with identical structure on guardrail 16' being indicated with "'".

Lower end frame 12 includes upstanding legs 18 and 20 which are formed from round tubes. The upper end of leg 18 has an opening 22 formed therein which extends through leg 18. Pipe stub 24 is received in the upper end of leg 18 and is welded in place by welding pipe stub 24 to leg 18 through the opening 22.

The upper end of leg 20 is also provided with an opening 26 formed therein. A pipe stub 28 is inserted into the upper end of leg 20 and is welded thereto through the opening 26. At least one lower cross brace 36 is welded to legs 18 and 20 and extends therebetween.

Upper end frame 14 includes horizontally spaced-apart legs 38 and 40. Leg 38 includes a lower end portion 42, intermediate portion 44, and upper end portion 46. As seen in the drawings, intermediate portion 44 extends upwardly and inwardly from the upper end of lower end portion 42.

Figure 3:
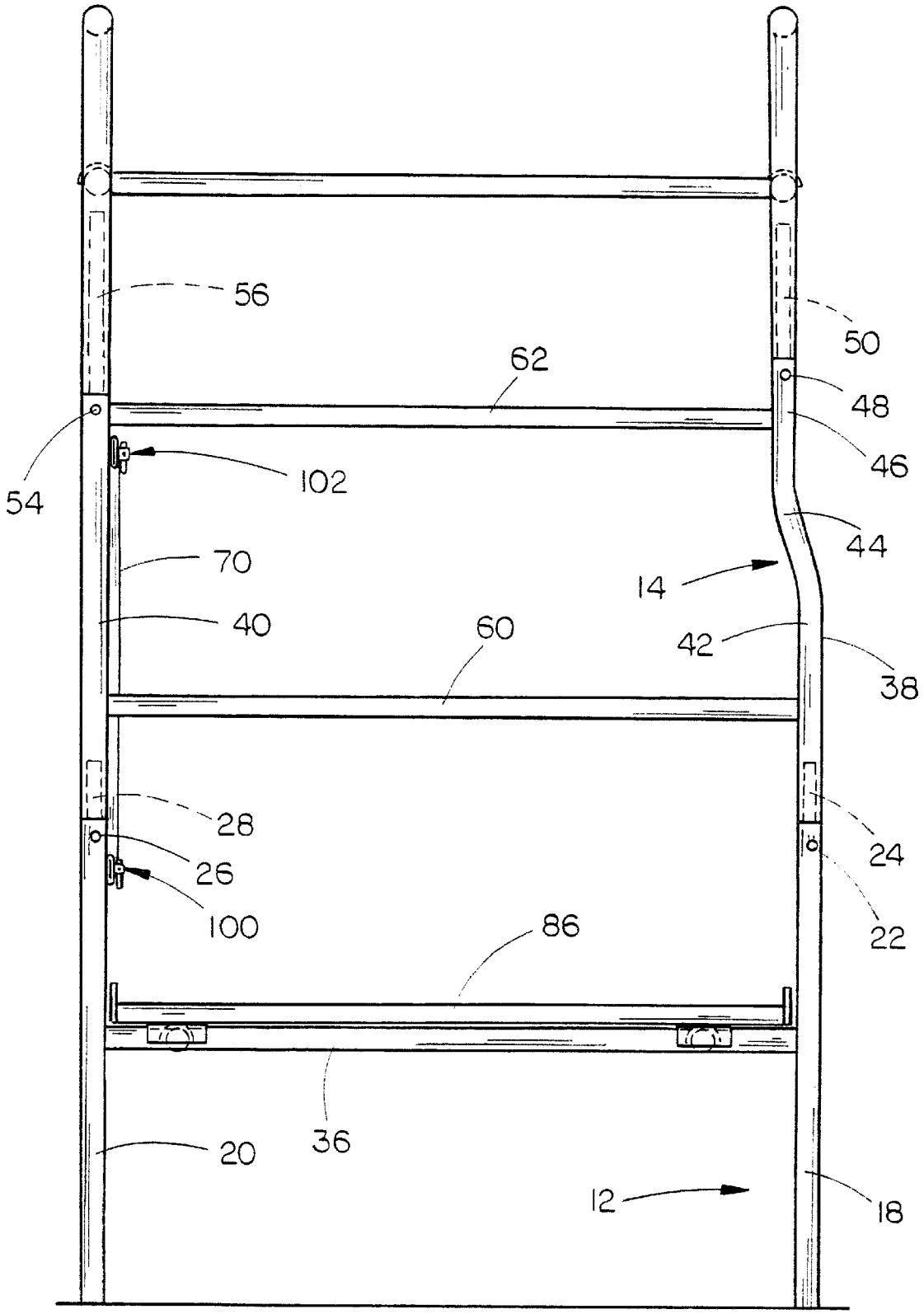
FIG. 3 is an end elevational view of the structure of FIG. 2.
Figure 4:
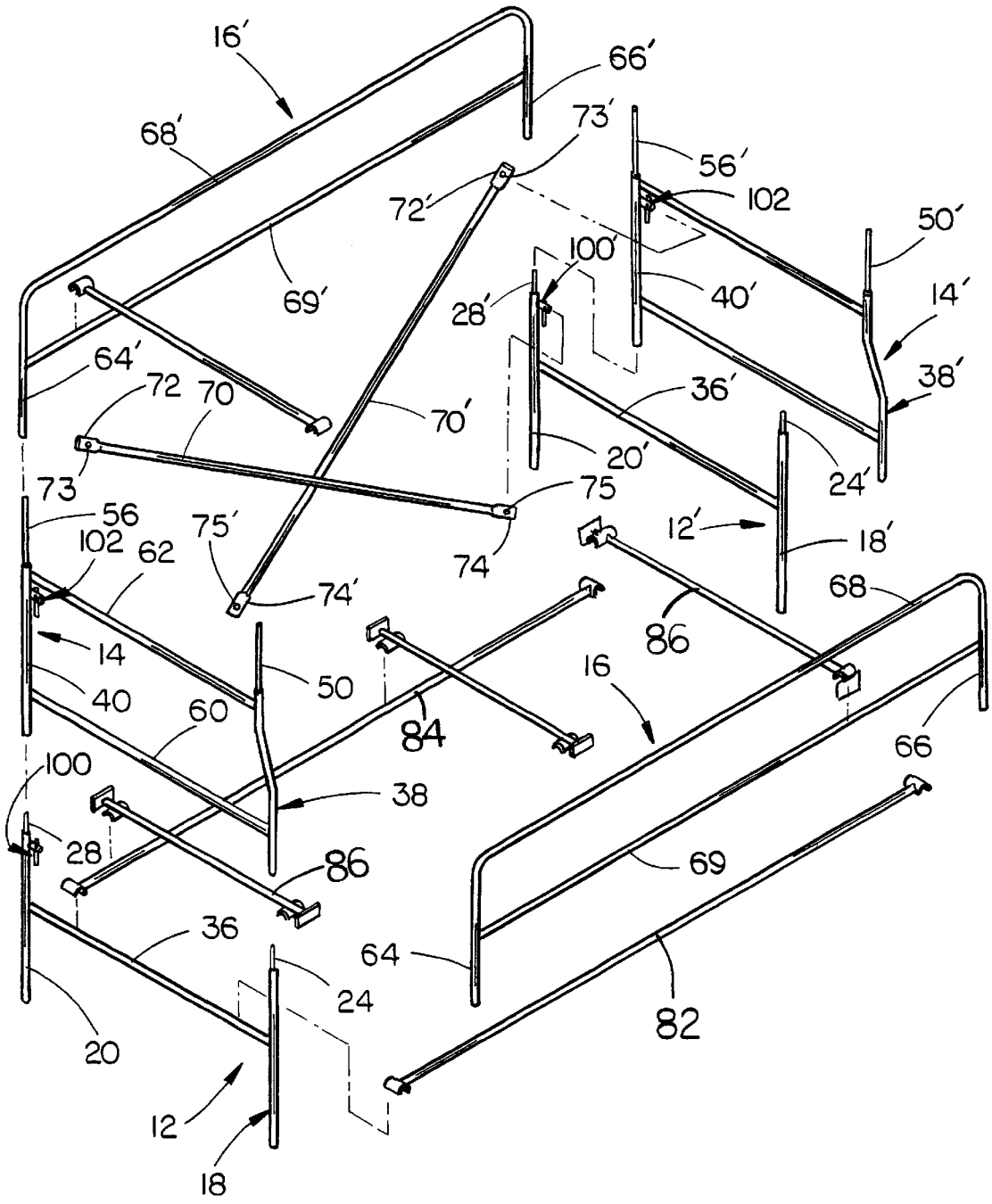
FIG. 4 is an exploded perspective view of the support structure of FIG. 2.
Figure 5:
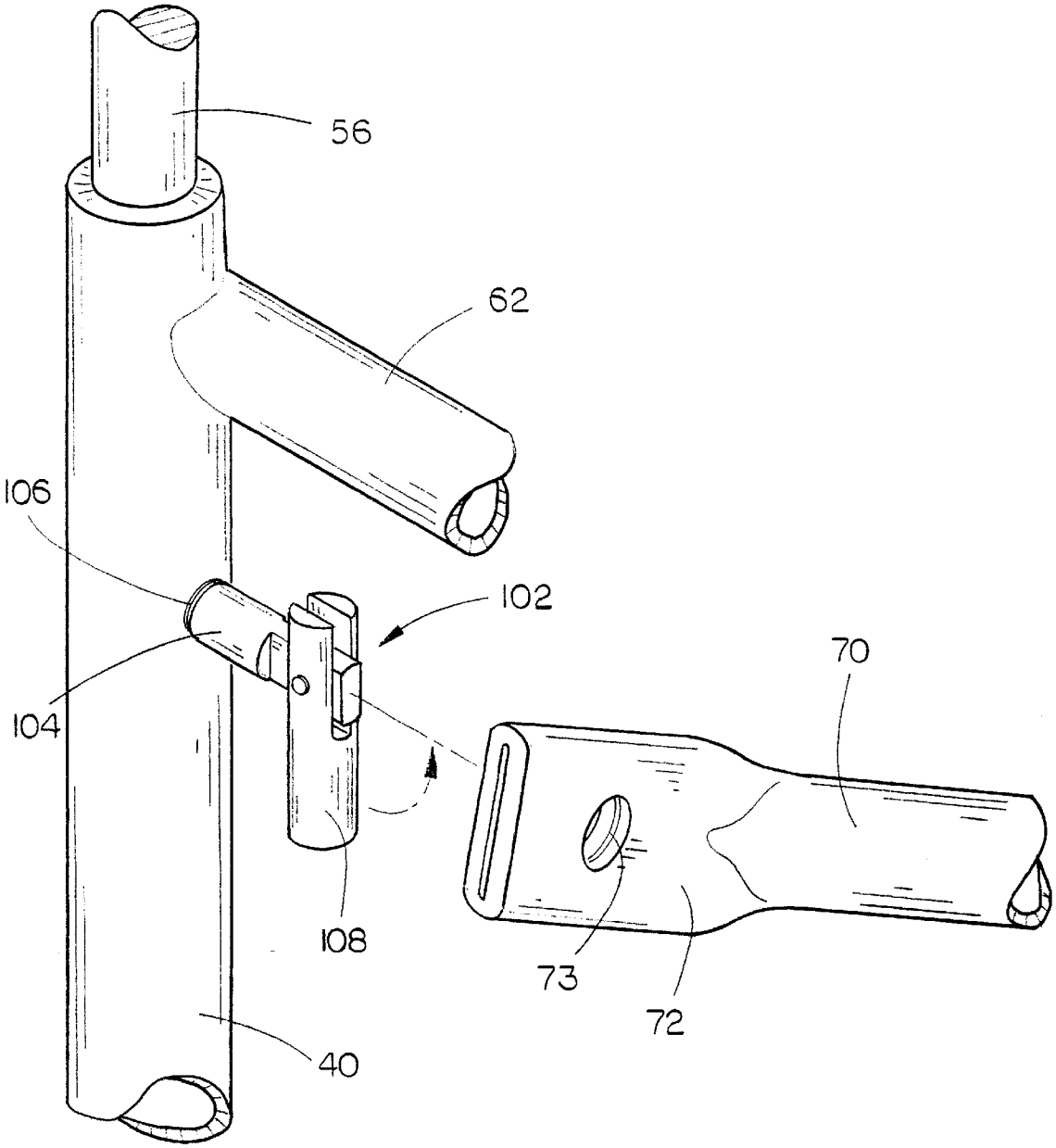
FIG. 5 is a perspective view illustrating the manner in which the cross braces are secured to the anchors.

The upper end of leg 38 has an opening 48 formed therein for weldment purposes. Pipe 50 is inserted into the upper end of leg 38 and is welded thereto through the opening 48. The upper end of leg 40 has an opening 54 formed therein for weldment purposes. Pipe 56 is inserted into the upper end of leg 40 and is welded thereto through the opening 54. First and second upper cross braces 60 and 62 are welded to legs 38 and 40 and extend therebetween, as seen in the drawings. Although it is preferred that two upper cross braces 60 and 62 be utilized, it is perhaps possible that any number of cross braces could be utilized. As seen in FIG. 3, the upper end of leg 40 is disposed below the upper end of leg 38. Although the upper and lower end frames are described as being separate components, which is the preferred embodiment, the upper and lower end frames could be a single component.

Guardrail 16 includes end portions 64 and 66 and top rail portion 68 extending between the upper ends thereof. A lower rail 69 is welded to and extends between leg portions 64 and 66, as seen in the drawings.

The numeral 70 refers to a diagonal brace having flat portions 72 and 74 formed in the upper and lower ends thereof, respectively. A diagonal brace 70' is also provided and is identical to diagonal brace 70. Flat portions 72' and 74' are formed in the upper and lower ends of the diagonal brace 70', respectively. Each of the flat portions 72, 74, 72' and 74' are provided with an opening formed therein which are identified by the reference numerals 73, 75, 73' and 75', respectively.

The numerals 100 and 102 refer to anchors which are welded to leg 20 and leg 40, respectively. The numerals 100' and 102' refer to anchors which are welded to leg 20' and leg 40', respectively. Inasmuch as anchors 100, 102, 100' and 102' are identical, only anchor 102 will be described in detail. Anchor 102 includes a shaft portion 104, one end of which is inserted into an opening 106 formed in leg 40 and which is welded to leg 40. The other end of shaft portion 104 includes a conventional retaining bar 108 which may be selectively pivotally moved to a position wherein it is longitudinally aligned with shaft portion 104 to a locking position wherein it is disposed transversely with respect to shaft portion 104. When the retaining bar 108 is longitudinally aligned with shaft portion 104, flat portion 72 of cross brace 70 may be connected to anchor 100 by causing the retaining bar 108 and shaft portion 104 to be received by opening 73 at which time the retaining bar 108 may be pivotally moved to its locking position to maintain cross brace 70 thereon.

The support structure as described thus far is assembled as will now be described. Lower end frame 12 is positioned in a vertically disposed position and the upper end frame 14 is mounted thereon by sliding the lower ends of legs 38 and 40 of upper end frame 14 onto the pipe stubs 24 and 28, respectively. Lower end frame 12 is then horizontally spaced from lower end frame 12 and is positioned in a vertically disposed position. Upper end frame 14' is then mounted on the upper end of lower end frame 12' in the same manner as upper end frame 14 is mounted on lower end frame 12.

Flat portion 72 of brace 70 is then secured to anchor 102 as previously described. Flat portion 74 of brace 70 is then secured to anchor 100'. Flat portion 72' of brace 70' is then secured to anchor 100 and flat portion 74' of brace 70' is secured to anchor 102'.

The numeral 76 refers to a cross support having arcuate sections or U-shaped sections 78 and 80 secured to the ends thereof. U-shaped sections 78 and 80 are adapted to receive brace 69 to enable the cross support 76 to be extended between the guardrails 16 and 16', as illustrated in the drawings. A plurality of the cross supports 76 are extended between the guardrails 16 and 16' for supporting a mattress 81 thereon. It is preferred that the height of the guardrails 16 and 16' be such that the upper surface of the mattress 81 positioned on the cross support 76 will be positioned below the upper end of the guardrails, as seen in FIG. 1.

Thus it can be seen that a support has been provided for a bed or mattress which may be easily and quickly assembled without the need for tools. If it is desired to support an additional mattress below the mattress 81, a pair of longitudinal accessory supports 82 and 84 are extended between the braces 36 and 36' of lower end frames 12 and 12', as illustrated in the drawings. Accessory cross supports 86 are then positioned on the supports 82 and 84, as illustrated in the drawings. The accessory supports just described enables a mattress to be positioned thereon or enables a sofa or desk to be placed thereon. The accessory supports could also be secured to and extended between the upper end frames 14 and 14' if additional space is desired below the accessory supports.

The support 10 is easily assembled and disassembled without the need for tools. The support 10 may be completely disassembled for storage or movement to another location.

Thus, it can been seen that the invention accomplishes at least all of its stated objectives.

I claim:

1. A support structure for a mattress, comprising:

an upstanding first lower end frame having upper and lower ends;

an upstanding second lower end frame, having upper and lower ends, horizontally spaced from said first lower end frame;

said first lower end frame comprising horizontally spaced first and second upstanding legs having upper and lower ends, and at least one horizontally extending brace secured to and extending between said first and second legs thereof;

said second lower end frame comprising horizontally spaced first and second upstanding legs having upper and lower ends, and at least one horizontally extending brace secured to and extending between said first and second legs of said second lower end frame thereof;

an upstanding first upper end frame having upper and lower ends;

an upstanding second upper end frame having upper and lower ends;

said first upper end frame comprising horizontally spaced first and second upstanding legs having upper and lower ends, and at least one horizontally extending brace secured to and extending between said first and second legs thereof;

said lower ends of said first and second legs of said first upper end frame being removably secured to said upper ends of said first and second legs of said first lower end frame;

said lower ends of said first and second legs of said second upper end frame being removably secured to said upper ends of said first and second legs of said second lower end frame;

said second leg of said first end frame having first and second anchors secured thereto and said second leg of said second end frame having third and fourth anchors secured thereto, wherein a first, elongated cross brace is removably secured to and extends between said first and third anchors and wherein a second, elongated cross brace is removably secured to and extends between said second and fourth anchors;

a first connector member removably secured to said upper ends of said first legs of said first and second upper end frames and extending therebetween;

a second connector member removably secured to said upper ends of said second legs of said first and second upper end frames and extending therebetween;

and mattress supports operatively directly removably secured to said first and second connector members and extending therebetween.

2. The support structure of claim 1 wherein said first connector member comprises an inverted U-shaped member.

3. The support structure of claim 1 wherein said second connector member comprises an inverted U-shaped member.

4. The support structure of claim 1 wherein said connector members comprise inverted U-shaped guardrails.

5. The support structure of claim 4 wherein each of said U-shaped guardrails has an upper end which protrudes above a mattress positioned on said mattress supports.

6. The support structure of claim 1 wherein a plurality of vertically spaced braces are secured to and extend between said first and second legs of each of said first and second upper end frames.

7. The support structure of claim 1 wherein said mattress supports comprise a plurality of horizontally spaced-apart support members operatively directly removably secured to said first and second connectors and which extend therebetween.

8. The support structure of claim 1 wherein each of said first legs of said first and second upper end frames comprises a lower end portion, an intermediate portion which extends upwardly from said lower end portion towards said second leg of the associated upper end frame, and an upper end portion which extends upwardly from the upper end of said intermediate portion.

9. The support structure of claim 1 further including at least two longitudinal accessory supports which are removably secured to said first and second lower end frames and which extend therebetween.

10. The support structure of claim 9 further including a plurality of accessory cross supports which are removably secured to said longitudinal accessory supports and which extend therebetween.

11. The support structure of claim 1 further including at least two longitudinal accessory supports which are removably secured to said first and second upper end frames and which extend therebetween.

12. The support structure of claim 11 further including a plurality of accessory cross supports which are removably secured to said longitudinal accessory supports and which extend therebetween.

* * * * *